US010704769B2

(12) United States Patent
Schaefer et al.

(10) Patent No.: US 10,704,769 B2
(45) Date of Patent: Jul. 7, 2020

(54) VEHICLE REFLECTOR ASSEMBLY WITH CIRCUIT BOARD RETENTION PLATE

(71) Applicant: Valeo North America, Inc., Seymour, IN (US)

(72) Inventors: Roger Schaefer, Columbus, IN (US); Timothy Belt, Madison, IN (US)

(73) Assignee: Valeo North America, Inc., Troy, MI (US)

( * ) Notice: Subject to any disclaimer, the term of this patent is extended or adjusted under 35 U.S.C. 154(b) by 274 days.

(21) Appl. No.: 14/937,080

(22) Filed: Nov. 10, 2015

(65) Prior Publication Data

US 2016/0061403 A1 Mar. 3, 2016

Related U.S. Application Data

(63) Continuation of application No. 13/568,748, filed on Aug. 7, 2012, now Pat. No. 9,200,774.

(51) Int. Cl.
*F21V 19/00* (2006.01)
*F21S 41/19* (2018.01)
(Continued)

(52) U.S. Cl.
CPC ..... *F21V 19/005* (2013.01); *F21S 41/192* (2018.01); *F21S 41/39* (2018.01); *F21S 43/14* (2018.01);
(Continued)

(58) Field of Classification Search
CPC .... F21S 48/211; F21S 48/212; F21S 48/1104; F21S 48/1109; F21S 48/115; F21S 48/13;
(Continued)

(56) References Cited

U.S. PATENT DOCUMENTS 5,954,423 A * 9/1999 Logan ..... F21V 5/00 362/235
6,015,223 A * 1/2000 Kidd ..... B60Q 1/302 362/235

(Continued)

FOREIGN PATENT DOCUMENTS

DE 102006002322 12/2007
EP 2481635 8/2012

OTHER PUBLICATIONS

Roemer, Andreas, Lighting unit e.g. elongated auxiliary brake light, for vehicle, has lighting element positioned on carrier module, and attaching unit provided such that attachment module is connected with conducting element, module and/or side wall, Dec. 27, 2007, English translation.

*Primary Examiner* — Alexander K Garlen
*Assistant Examiner* — James M Endo
(74) *Attorney, Agent, or Firm* — Valeo North America, Inc.

(57) ABSTRACT

A lamp reflector assembly that includes a lamp reflector and a circuit board holder plate. The lamp reflector and the circuit board holder plate each include guide ribs to hold a lamp circuit board in place in the reflector assembly. The board holder plate provides X, Y, Z location of the lamp circuit board as well as visual position verification of the lamp circuit board held in the reflector assembly. Finger tabs protruding from the lamp circuit board through slots in the board holder plate permit repositioning the lamp circuit board so that the lamp circuit board, the board holder plate, and the lamp reflector are properly positioned relative to each other prior to securing the board holder plate to the reflector.

14 Claims, 5 Drawing Sheets

(51) Int. Cl.

| | |
|---|---|
| ***F21S 41/39*** | (2018.01) |
| ***F21V 17/10*** | (2006.01) |
| ***F21V 17/00*** | (2006.01) |
| ***F21Y 115/10*** | (2016.01) |
| ***F21W 107/00*** | (2018.01) |
| ***F21S 43/19*** | (2018.01) |
| ***F21S 43/14*** | (2018.01) |
| ***F21S 43/37*** | (2018.01) |

(52) U.S. Cl.
CPC ..... *F21S 43/19* (2018.01); *F21S 43/37* (2018.01); *F21V 17/101* (2013.01); *F21S 41/19* (2018.01); *F21V 17/005* (2013.01); *F21V 17/104* (2013.01); *F21V 19/003* (2013.01); *F21V 19/0035* (2013.01); *F21W 2107/00* (2018.01); *F21Y 2115/10* (2016.08); *Y10T 29/49826* (2015.01)

(58) Field of Classification Search
CPC ..... F21S 48/1305; F21S 48/215; F21S 48/23; F21S 48/232; F21S 48/1122; F21S 48/1311; F21S 48/1323; F21S 48/1341; F21S 48/1347; F21S 48/1352; F21S 48/1358; F21S 48/1364; F21S 48/137; B60C 1/0483; B60C 1/2696; F21V 17/14; F21V 17/104; F21V 17/005; F21V 17/06; F21V 19/003; F21V 19/0035; F21V 19/0045; F21V 19/004; F21V 17/108; F21V 17/164; F21V 17/16; F21V 19/001; F21V 19/0015; F21V 19/005; F21V 19/0055; F21V 19/04; F21V 19/042; F21V 19/045; F21Y 2107/50; F21Y 2107/80; B60Q 1/0483; B60Q 1/2696; F21K 9/20
See application file for complete search history.

(56) References Cited

U.S. PATENT DOCUMENTS

| | | | | |
|---|---|---|---|---|
| 6,095,663 | A | 8/2000 | Pond et al. | |
| 6,220,724 | B1 * | 4/2001 | Krokeide | A62B 3/00 362/240 |
| 6,500,018 | B1 | 12/2002 | Pfaffenberger et al. | |
| 6,561,689 | B1 | 5/2003 | Kidd et al. | |
| 6,641,284 | B2 | 11/2003 | Stopa et al. | |
| 6,902,308 | B2 | 6/2005 | Love | |
| 6,939,029 | B1 | 9/2005 | Stahel et al. | |
| 7,055,996 | B2 | 6/2006 | Pond et al. | |
| 7,245,203 | B2 | 7/2007 | Stephens et al. | |
| 7,290,911 | B2 | 11/2007 | Tsukamoto et al. | |
| 7,407,307 | B2 | 8/2008 | Hiratsuka | |
| 7,414,861 | B2 | 8/2008 | Tsai | |
| 7,841,742 | B2 | 11/2010 | Freeman et al. | |
| 7,845,829 | B2 | 12/2010 | Shaner | |
| 7,914,162 | B1 | 3/2011 | Huang | |
| 2004/0076004 | A1 | 4/2004 | Smith, Jr. | |
| 2005/0068723 | A1 * | 3/2005 | Squillante | G06F 1/20 361/679.46 |
| 2005/0237760 | A1 * | 10/2005 | Tsukamoto | F21S 48/212 362/545 |
| 2006/0028830 | A1 | 2/2006 | Tsai | |
| 2006/0092659 | A1 * | 5/2006 | Bynum | B60Q 3/51 362/549 |
| 2007/0147048 | A1 * | 6/2007 | Guo | F21S 10/02 362/341 |
| 2008/0031004 | A1 | 2/2008 | Chu | |
| 2008/0180972 | A1 | 7/2008 | Sakamoto et al. | |
| 2009/0296418 | A1 | 12/2009 | Luo et al. | |
| 2010/0142217 | A1 | 6/2010 | Gerhard et al. | |
| 2010/0214768 | A1 | 8/2010 | Dixon et al. | |
| 2010/0271816 | A1 | 10/2010 | Ozeki et al. | |
| 2010/0302777 | A1 | 12/2010 | Knoll et al. | |
| 2011/0007517 | A1 | 1/2011 | Chien | |
| 2011/0032703 | A1 * | 2/2011 | Pearson | F21S 8/033 362/249.02 |
| 2011/0058387 | A1 | 3/2011 | Matsunaga et al. | |
| 2011/0157901 | A1 * | 6/2011 | Chen | F21V 17/164 362/373 |
| 2011/0170034 | A1 * | 7/2011 | Jeong | G02B 6/0068 349/61 |
| 2011/0248132 | A1 * | 10/2011 | Hirota | H05K 7/1405 248/222.14 |
| 2012/0002427 | A1 * | 1/2012 | Moon | F21K 9/00 362/382 |
| 2012/0175653 | A1 * | 7/2012 | Weber | F21V 15/01 257/98 |
| 2012/0206917 | A1 * | 8/2012 | Burkard | F21V 17/164 362/249.01 |
| 2012/0243227 | A1 * | 9/2012 | Shimizu | F21S 8/04 362/249.01 |

* cited by examiner

VEHICLE REFLECTOR ASSEMBLY WITH CIRCUIT BOARD RETENTION PLATE

CROSS-REFERENCE TO RELATED APPLICATIONS

This application is a continuation of U.S. application Ser. No. 13/568,748 filed Aug. 7, 2012, which application is incorporated herein by reference and made a part hereof.

BACKGROUND OF THE INVENTION

1. Field of the Invention

The present disclosure relates to lamp reflectors holding one or more lamp circuit boards. Lamp reflectors are used in motor vehicles, but are not limited thereto.

2. Description of the Related Art

In a prior art tail lamp vehicle reflector, the lamp FR4 circuit boards were wedged into tee slots located on the non-reflective rear side of the reflector. The reflector rear surface had datum surfaces to locate the circuit board. LEDs on the circuit board were in register with apertures on the reflector. Once the lamp circuit boards are inserted into the tee slots, the lamp circuit boards are directly fastened, e.g., screwed, to the reflector.

Other arrangements to hold circuit boards are known in U.S. Pat. No. 7,841,742 (Freeman); U.S. Pat. No. 7,845,829 (Shaner); U.S. Pat. No. 7,414,861 (Tsai) and U.S. Pat. No. 6,500,018 (Pfaffenberger).

SUMMARY OF THE INVENTION

In one embodiment, a lamp reflector assembly includes a lamp reflector and a lamp circuit board holder plate that holds a lamp circuit board, accurately positioned, to the reflector, as well as a related assembly method.

Such embodiments improve visual position verification of the lamp circuit board and more accurate positioning of the lamp circuit board with respect to the reflector.

The reflector includes one or more first guide ribs so that an operator (which may be a robot) can place first the lamp circuit board into the reflector. The board holder plate includes one or more second guide ribs which force the placed lamp circuit board into a design X, Y, Z position with respect to the reflector when the board holder plate is loaded/mounted to the reflector.

With the board holder plate loaded/mounted on the reflector, finger slots allow position verification of the lamp circuit board with respect to the thus-far assembled reflector assembly. The finger slots are located on the board holder plate; a portion of the circuit board protrudes through the finger slots and is accessible to operator manipulation. Upon successful position verification, a securing element secures the board holder plate to the reflector with the lamp circuit board held in the design position. Thereby, the assembly accommodates visual position verification of the lamp circuit board and more accurate positioning of the lamp circuit board without the need to wedge the circuit board into a slot.

In one aspect, one embodiment of the invention comprises a lamp reflector assembly, comprising at least one lamp circuit board, the at least one lamp circuit board having one or more solid-state light elements positioned thereon, a lamp reflector, and a circuit board holder plate adapted to be mounted to the lamp reflector, wherein at least one of the lamp reflector or the circuit board holder plate comprises at least one guide for locating and retaining the at least one lamp circuit board in a predetermined position relative to the lamp reflector.

In another aspect, another embodiment of the invention comprises A lamp reflector assembly, comprising a plurality of lamp circuit boards, the plurality of lamp circuit boards having one or more solid-state light elements positioned thereon, a lamp reflector having a plurality of wall surfaces having a front face defining a reflective front surface and a rear face defining a rear surface, the lamp reflector including a plurality of circuit board first guide ribs, located on the rear face, and the plurality of wall surfaces having one or more apertures through which light rays pass, and a circuit board holder plate having a plurality of second guide ribs, the circuit board holder plate being secured to the lamp reflector, wherein the plurality of circuit board first guide ribs of the lamp reflector and the plurality of second guide ribs of the circuit board holder plate adapted to support the plurality of lamp circuit boards in a generally perpendicular position between the lamp reflector and the circuit board holder plate and in a predetermined position with respect to the plurality of wall surfaces, respectively, the plurality of circuit board first guide ribs and the plurality of second guide ribs support the plurality of lamp circuit boards in a generally perpendicular position between the lamp reflector and the circuit board holder plate, the plurality of lamp circuit boards being captured between the plurality of circuit board first guide ribs and the plurality of second guide ribs in order to support the plurality of lamp circuit boards between the circuit board holder plate and the rear surface of the lamp reflector and to secure the plurality of lamp circuit boards in the predetermined position in the lamp reflector assembly, and wherein the plurality of second guide ribs cooperate to define a receiving aperture for receiving the plurality of lamp circuit boards, the circuit board holder plate further comprising at least one slot and the plurality of lamp circuit boards having a tab that is received in the at least one slot, wherein the lamp reflector is concave and comprises the plurality of wall surfaces, the plurality of circuit board first guide ribs cooperating with the plurality of second guide ribs to support the plurality of lamp circuit boards between the lamp reflector and the circuit board holder plate and to support the plurality of lamp circuit boards in different planes in the lamp reflector, wherein the plurality of lamp circuit boards are generally planar and each comprises a longitudinal surface for supporting the one or more solid-state light elements, wherein the longitudinal surfaces of the plurality of lamp circuit boards lie in the different planes.

This invention, including all embodiments shown and described herein, could be used alone or together and/or in combination with one or more of the features covered by one or more of the claims set forth herein, including but not limited to one or more of the features or steps mentioned in the following bullet list and the claims.

- The lamp reflector assembly wherein the at least one guide comprises a first guide rib and a second guide rib, at least one of the first guide rib and the second guide rib having a shape that forces the at least one lamp circuit board toward a rear face of the lamp reflector, the shape comprising an inclined surface that will bear on a rear face of the at least one lamp circuit board thereby forcing the at least one lamp circuit board towards the rear face of the lamp reflector.
- The lamp reflector assembly wherein at least the first guide rib is located on the lamp reflector and has the shape forcing the at least one lamp circuit board toward the rear face of the lamp reflector.

The lamp reflector assembly wherein at least the second guide rib is located on the circuit board holder plate and has the shape forcing the at least one lamp circuit board toward the rear face of the lamp reflector.

The lamp reflector assembly wherein both the first guide rib and the second guide rib have the shape forcing the at least one lamp circuit board toward the rear face of the lamp reflector.

The lamp reflector assembly wherein at least one of the first guide rib and the second guide rib comprise a locator rib, the locator rib engaging the at least one lamp circuit board to thereby locate a position of the at least one lamp circuit board laterally with respect to the rear face of the lamp reflector.

The lamp reflector assembly wherein at least the first guide rib comprises the locator rib.

The lamp reflector assembly wherein at least the second guide rib comprises the locator rib.

The lamp reflector assembly wherein both the first guide rib and the second guide rib comprise at least one the locator rib.

The lamp reflector assembly wherein the circuit board holder plate further comprises a finger slot, and with the at least one lamp circuit board mounted to the lamp reflector by the circuit board holder plate, a finger tab projecting from a perimeter edge of the at least one lamp circuit board extends into the finger slot of the circuit board holder plate, whereby the finger tab extending into the finger slot facilitates repositioning the at least one lamp circuit board being mounted in the predetermined position with respect to the rear face of the lamp reflector.

The lamp reflector assembly wherein the lamp reflector further comprises heat stake tabs extending from the rear face, the circuit board holder plate further comprises tab holes positioned to receive the heat stake tabs therethrough when the circuit board holder plate mounts the at least one lamp circuit board to the lamp reflector, and with the circuit board holder plate mounting the at least one lamp circuit board to the lamp reflector, the heat stake tabs are configured to provide a weld that secures the circuit board holder plate and the lamp reflector together.

The lamp reflector assembly wherein at least one of the first guide rib and the second guide rib comprise a locator rib, the locator rib engaging the at least one lamp circuit board to thereby locate a position of the at least one lamp circuit board laterally with respect to the rear face of the lamp reflector.

The lamp reflector assembly wherein the at least one lamp circuit board comprises a notch extending into a perimeter edge of the at least one lamp circuit board, the notch positioned to engage with the locator rib to locate the position of the at least one lamp circuit board laterally with respect to the rear face of the lamp reflector.

The lamp reflector assembly wherein the circuit board holder plate is transparent, thereby facilitating visual inspection of the first guide rib and the second guide rib mounting the lamp circuit board in the predetermined position with respect to the rear face of the lamp reflector.

The lamp reflector assembly wherein the circuit board holder plate is generally flat.

The lamp reflector assembly further comprising a plurality of the at least one lamp circuit board, the circuit board holder plate fixedly mounting the plurality of the at least one lamp circuit board to the lamp reflector.

The lamp reflector assembly wherein at least one of the plurality of circuit board first guide ribs and the plurality of second guide ribs has a shape forcing a mounted circuit board toward the rear face of the reflector, the shape comprising an inclined surface that will bear on a rear face of the mounted circuit board thereby forcing the mounted circuit board towards the rear face of the reflector.

The lamp reflector assembly wherein at least the plurality of circuit board first guide ribs has the shape forcing the mounted circuit board toward the rear face of the reflector.

The lamp reflector assembly wherein at least the plurality of second guide ribs has the shape forcing the mounted circuit board toward the rear face of the reflector.

The lamp reflector assembly wherein both the plurality of circuit board first guide ribs and the plurality of second guide ribs have the shape forcing the mounted circuit board toward the rear face of the reflector.

The lamp reflector assembly wherein at least one of the plurality of circuit board first guide ribs and the plurality of second guide ribs comprises a locator rib, the locator rib engaging the mounted circuit board to thereby locate a position of the mounted circuit board laterally with respect to the rear face of the reflector.

The lamp reflector assembly wherein the at least one of the plurality of circuit board first guide ribs comprises the locator rib.

The lamp reflector assembly wherein the plurality of second guide ribs comprises the locator rib.

The lamp reflector assembly wherein both the plurality of circuit board first guide ribs and the plurality of second guide ribs comprise at least one the locator rib.

The lamp reflector assembly wherein the circuit board holder plate further comprises a finger slot, and with the plurality of lamp circuit boards mounted to the reflector by the circuit board holder plate, a finger tab projecting from a perimeter edge of the plurality of lamp circuit boards extends into the finger slot of the circuit board holder plate, whereby the finger tab extending into the finger slot facilitates repositioning the plurality of lamp circuit boards being mounted in the predetermined position with respect to the rear face of the reflector.

The lamp reflector assembly wherein the reflector further comprises heat stake tabs extending from the rear face, the circuit board holder plate further comprises tab holes positioned to receive the heat stake tabs therethrough when the circuit board holder plate mounts the plurality of lamp circuit boards to the reflector, and with the circuit board holder plate mounting the plurality of lamp circuit boards to the reflector, the heat stake tabs are configured to provide a weld that secures the circuit board holder plate and the reflector together.

The lamp reflector assembly wherein at least one of the plurality of circuit board first guide ribs and the plurality of second guide ribs comprises a locator rib, the locator rib engaging a mounted circuit board to thereby locate a position of the mounted circuit board laterally with respect to the rear face of the reflector.

The lamp reflector assembly wherein the plurality of lamp circuit boards comprises a notch extending into a perimeter edge of the plurality of lamp circuit boards, the notch positioned to engage with the locator rib to locate the position of the plurality of lamp circuit boards laterally with respect to the rear face of the reflector.

The lamp reflector assembly wherein the circuit board holder plate is transparent, thereby facilitating visual inspection of the plurality of circuit board first guide ribs and the plurality of second guide ribs mounting the plurality of lamp circuit boards in the predetermined position with respect to the rear face of the reflector.

The lamp reflector assembly wherein the circuit board holder plate fixedly mounting the plurality of lamp circuit boards to the reflector.

These and other objects and advantages of the invention will be apparent from the following description, the accompanying drawings and the appended claims

BRIEF DESCRIPTION OF THE ACCOMPANYING DRAWINGS

Features and advantages of the claimed subject matter will be apparent from the following detailed description of embodiments consistent therewith, which description should be considered with reference to the accompanying drawings, wherein:

DETAILED DESCRIPTION OF THE PREFERRED EMBODIMENTS

The embodiments provide a lamp reflector assembly 10 suitable as a vehicle lamp. The embodiment disclosed below concerns a vehicle tail lamp; however, the other embodiments are not limited to vehicle lamps.

Figure 1:
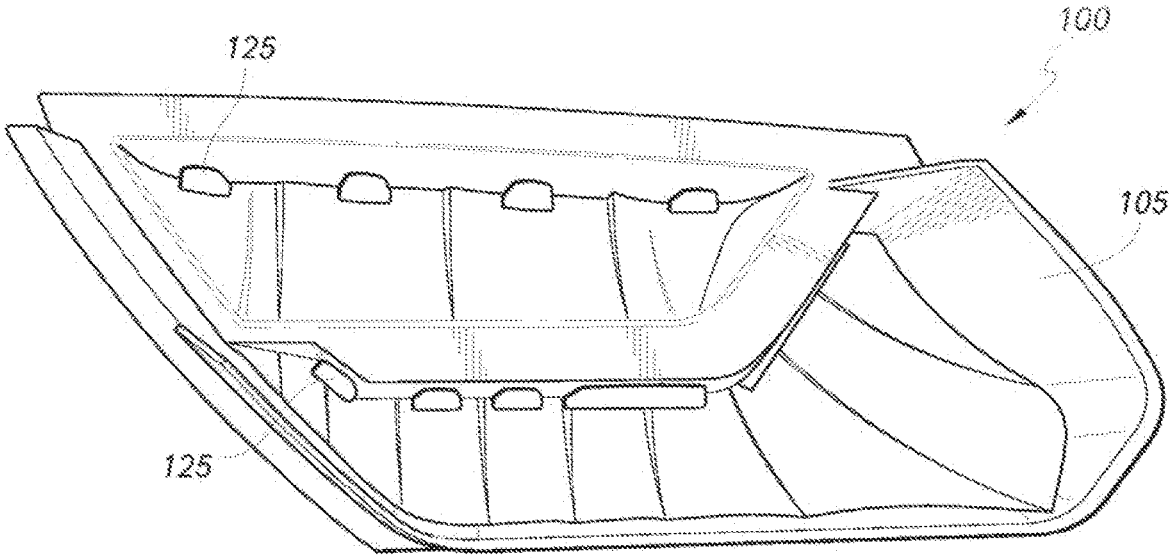
FIG. 1 is an front view of a lamp reflector.
Figure 2:
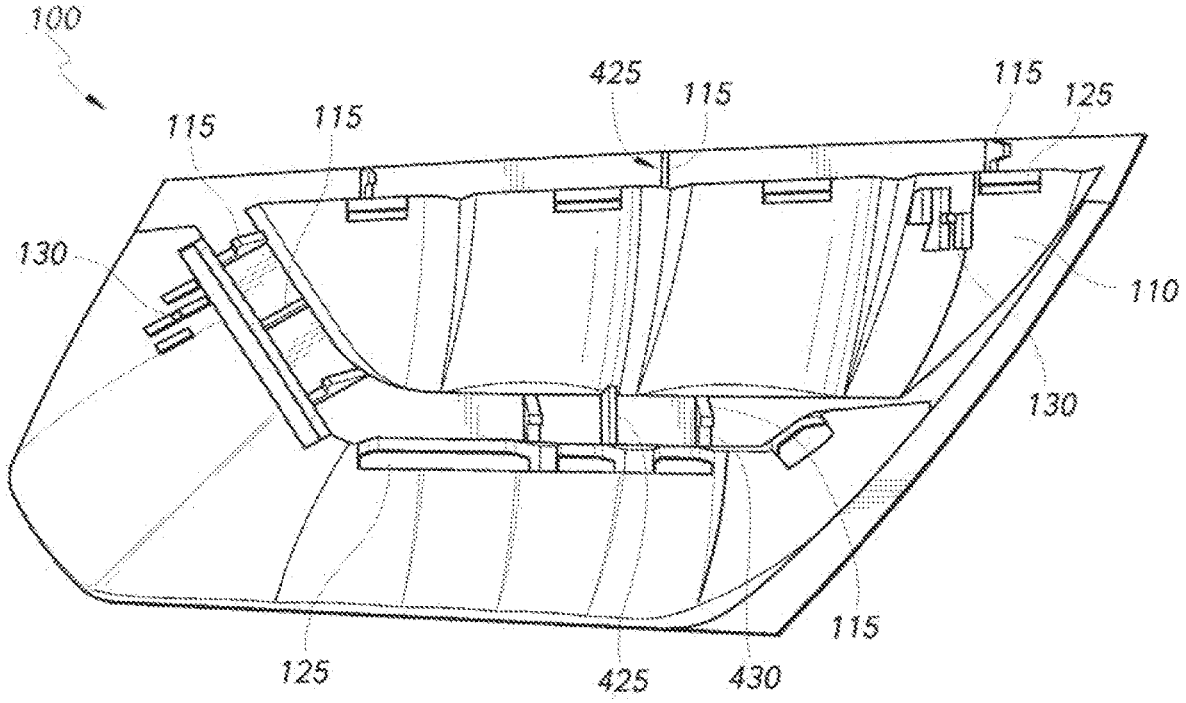
FIG. 2 is an rear view of the lamp reflector.
Figure 3:
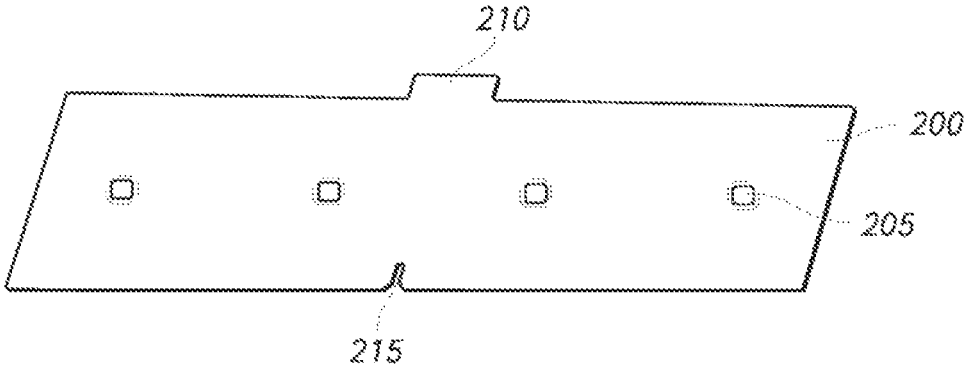
FIGS. 3-5 show lamp circuit boards.
Figure 4:
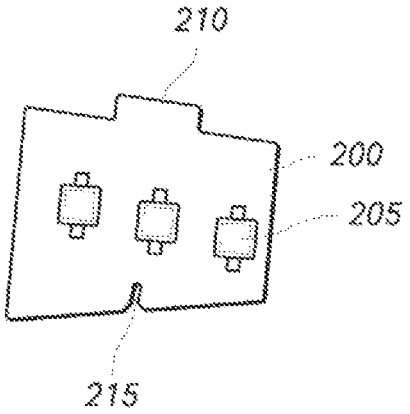
Figure 5:
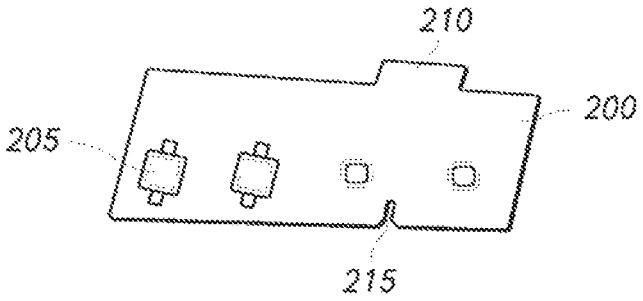

A lamp reflector 100 includes a front face 105 defining a reflective front surface (FIG. 1) and a rear face 110 defining a rear surface (FIG. 2). Circuit board first guide ribs 115 are located on the rear face 110 of the reflector 100. FIGS. 3-5 show exemplary lamp circuit boards 200, on one of which is mounted LEDs.

Figure 6:
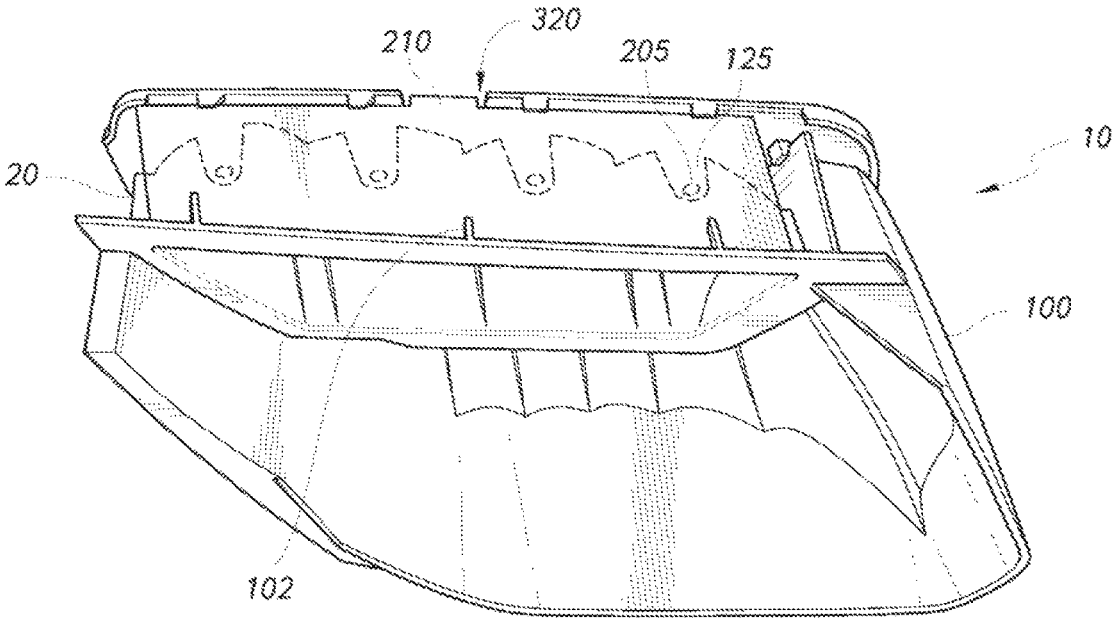
FIGS. 6-7 show the lamp reflector assembly, showing two lamp circuit boards mounted to the lamp reflector.
Figure 7:
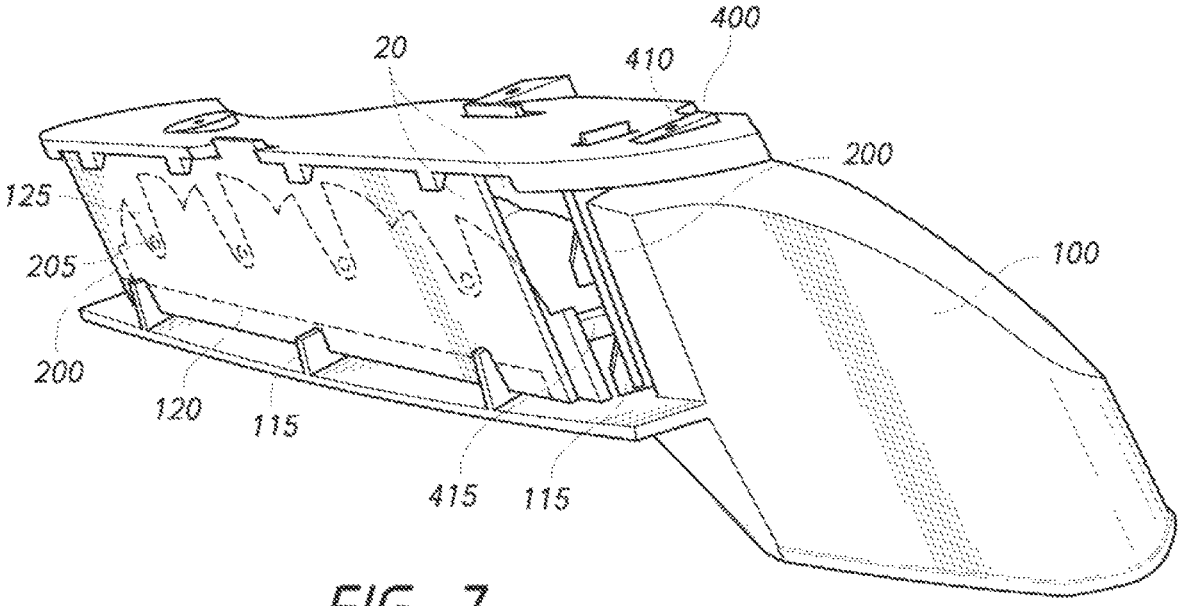

In a lamp reflector assembly 10, at least one lamp circuit board 200 is mounted to the first guide ribs 115 on the rear face 110 of the reflector 100 so that the circuit board 200 is in a design X, Y, Z position 20 with respect to the reflector 100. The design X, Y, Z position is a predetermined X, Y, Z position of the circuit board with respect to the rear face 110 of the reflector 100. FIG. 6 shows the lamp reflector assembly 10, showing two of the lamp circuit boards 200 mounted to the lamp reflector 100, as viewed from the front face of the lamp reflector 100. FIG. 7 is an enlarged portion, from slightly different angle, of the upper, right portion of FIG. 6. In preferred embodiments, each reflector rear surface 110 is surrounded by three circuit boards 200, each arranged generally along a principal major side of the reflector 100.

Figure 8:
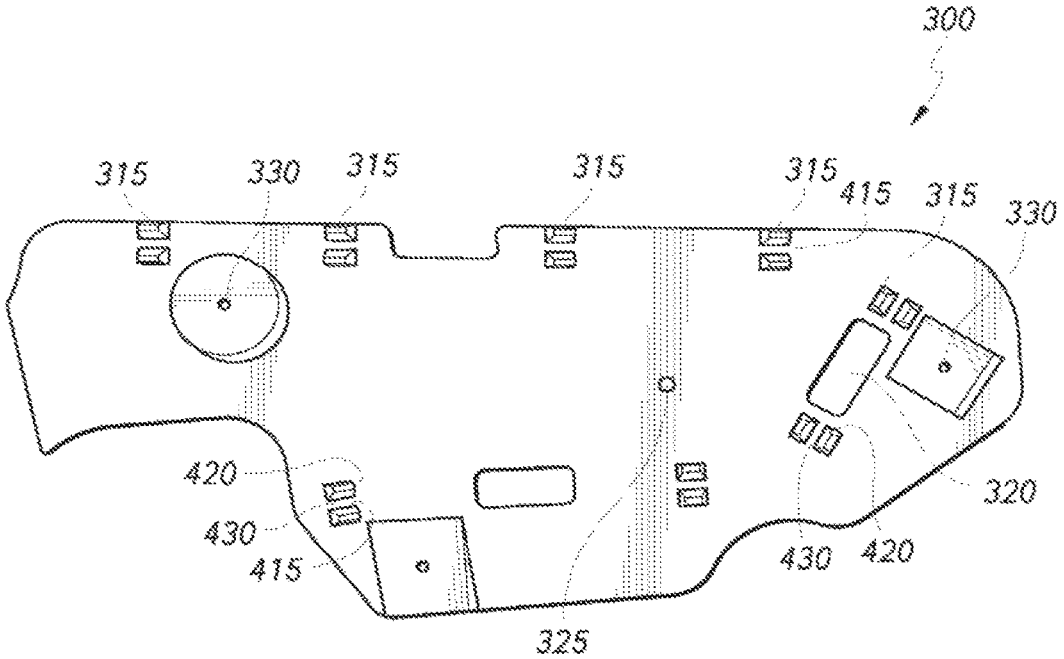
FIGS. 8-9 show inside and outside views of a circuit board holder plate.
Figure 9:
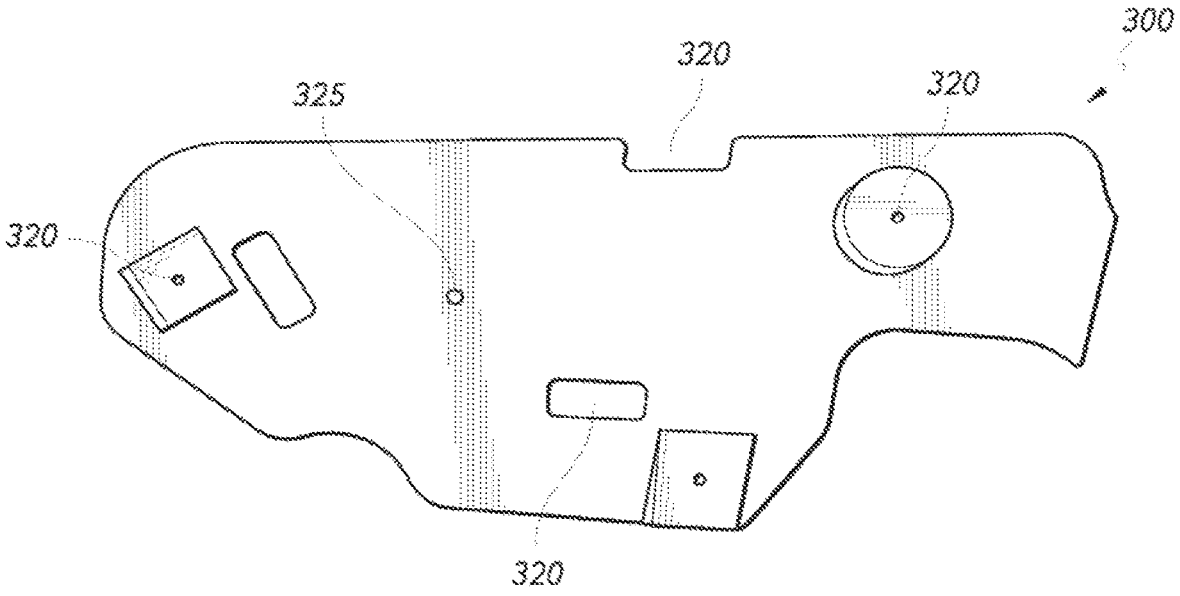

A circuit board holder plate 300, secured to reflector 100, holds the mounted circuit board 200 in the design X, Y, Z position 20 with respect to reflector 100. FIGS. 8-9 show inside and outside views of a circuit board holder plate 300. Board holder plate 300 includes circuit board second guide ribs 315 and finger slots 320. Second guide ribs 315 are grouped in pairs spaced apart a width of circuit board 200 to receive it therebetween. As seen in FIG. 8, board holder plate 300 hold three circuit boards in three different linear slots defined preferably by sets of co-linear arranged pairs of second guide ribs 315. Finger slots 320 are located within an interior of circuit board holder plate 300 or along a perimeter of circuit board holder plate 300, e.g. FIG. 9. The circuit board holder plate 300 is generally plate-like or flat. Finger slots 320 serve as receiving apertures. Accordingly, finger slots 320 may be in the form of close-sided holes, castellations, or indents along the edges of circuit board holder plate 300, as appropriate for any given embodiment.

The lamp circuit board 200, itself made of conventional material such as an FR4 board, includes one of more solid-state light elements 205 positioned thereon. The light element(s) 205 may be a light emitting diode(s) (LEDs), although other solid-state light elements 205 may be provided.

The lamp reflector 100 further includes one or more slotted holes 125 (apertures). The slotted holes 125 are positioned so that when the circuit board 200 is fixedly mounted to the reflector 100, a corresponding one of the light elements 205 is located adjacent the slotted hole 125, and in registration therewith, so that light emitted from the corresponding light element 205 passes through the slotted hole 125 to thereby illuminate the reflective front surface. FIGS. 6-7 show the slotted holes 125 and the light elements 205 in dashed lines, the light elements 205 each located adjacent a corresponding one of the slotted holes 125, and in registration therewith, so that light emitted from the light elements 205 pass through the slotted holes 125 to thereby illuminate the reflective front surface.

In a method of assembling the lamp reflector assembly 10, with the reflector front face 105 placed down, the rear surface 110 and first guide ribs 115 are exposed to an operator as shown in FIG. 2.

The operator first places the lamp circuit board 200 into first guide ribs 115. Multiple lamp circuit boards 200, for example three, are placed around the rear face 110 periphery of reflector 100. It is optionally preferred that for each reflector 100, at least one (preferably only one) circuit board 200 bear LEDs, and that the other two circuit boards 200 do not bear LEDs but carry driver electronics.

The operator second mounts the board holder plate 300 to the reflector 100 with the placed lamp circuit board 200 engaged into the second guide ribs 315 as shown in FIGS. 6-7. Mounting the board holder plate 300 to the reflector 100 fixedly mounts the circuit board 200 in the design/predetermined X, Y, Z position 20 with respect to the rear face 110 of the reflector 100. The use of board holder plate 300 is especially advantageous to locate multiple circuit boards 200 around the somewhat sloping, convex or humped lateral sides of the rear face 110 of reflective portion 105 since while the circuit boards 200 are spatially separated from one another and aligned along different planes, e.g. parallel or intersecting planes, the board holder plate 300 tends to act as a cap to capture all the so-placed circuit boards 200 prior to final fixation (such as heat staking) and counteract a tendency of the circuit boards 200 to misalign.

Placing a securing element 400 with respect to the board holder plate 300 and reflector 100 secures the mounted circuit board(s) 200 in the design X, Y, Z position 20 with respect to the rear face 110 of the reflector 100. The securing element may be, e.g., a weld 410 welding the board holder plate 300 and the reflector 100 together, a screw 405 passing through a screw hole 325 in the board holder plate 300 and into the reflector 100, or any suitable element that secures the board holder plate 300 and the reflector 100 together, or combination thereof.

In one embodiment, the reflector 100 comprises heat stake tabs 130 extending from the rear face 110; and the board holder plate 300 comprises tab holes 330 positioned to receive the stake tabs 130 therethrough when the board holder plate 300 is mounted to the reflector 100. In this position, the heat stake tabs 130 may be utilized in providing a weld 410 that secures the board holder plate 300 and the reflector 100 together.

Using the finger slots 320, and prior to securing the board holder plate 300 to the reflector 100, e.g., by heat staking, the operator performs visual position verification of the circuit board(s) 200 with respect to the reflector 100 and alignment of the circuit board(s) 200 so that the upwardly facing edges of the circuit board(s) 200 are received in the second guide ribs 315 of the board holder plate 300 and the reflector's heat stake tabs 130 align with the board holder plate's tab holes 330.

Optionally, board holder plate 300 is transparent, thereby facilitating the operator to see the placement of the lamp circuit board 200 in the first and second guide ribs 115, 315. The circuit board holder plate 300 being generally plate-like or flat further helps realignment and ease of any pick-and-place operation used in assembly.

Optionally, each embodiment may have one or more finger slots 320. When present, the finger slots 320 allow the operator to easily move and re-orient the lamp circuit board 200 with respect to the first and second guide ribs 115, 315 to thereby ensure proper seating of the lamp circuit board 200 in the first and second guide ribs 115, 315 as well as locating the lamp circuit board 200 in the correct predetermined X, Y, Z position 20 with respect to the rear face 110 of the reflector 100, with each light element 205 positioned adjacent to a corresponding slotted hole 125 so that light emitted from the each light element 205 passes through the corresponding slotted hole 125 to thereby illuminate the reflective front surface 105 of the reflector 100.

Figure 10:
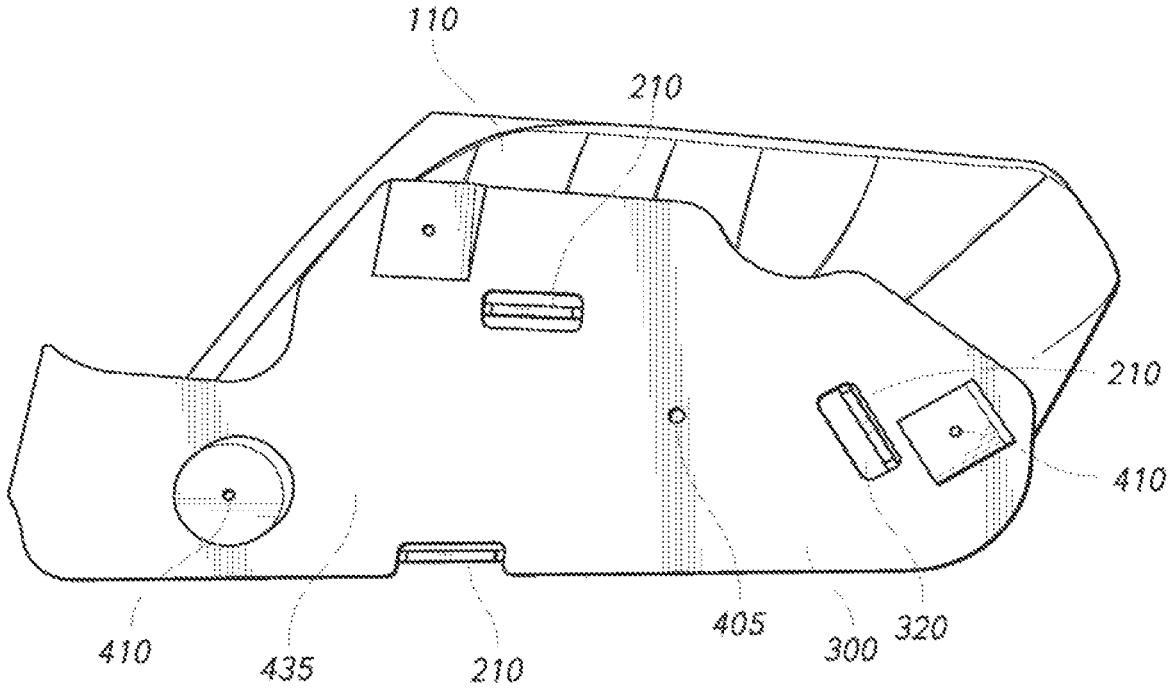
FIG. 10 shows the lamp reflector assembly from a rear view.

In preferred embodiments, the lamp circuit board 200 includes a tab 210, e.g., a finger tab 210, projecting from one perimeter edge of the lamp circuit board 200. When the lamp circuit boards 200 are mounted to the reflector 100 and the board holder plate 300 placed atop, the finger tab 210 of each respective circuit board 200 extends into, or preferably through, a respective finger slot 320 of the board holder plate 300 to be grasped for manipulation of the circuit board 200. Most preferably when in situ, finger tab 210 extends through the thickness of board holder plate 300 and exits proud of the rear surface thereof. As shown in FIG. 10, the finger tab 210 extends through the finger slot 320 with slight clearance. Thus, if parts are misaligned, then from the standpoint of each circuit board 200, slight displacement of the finger tab 210 allows proper alignment of each lamp circuit board 200, the board holder plate 300, and the lamp reflector 100 parts relative to each other. For example, slight displacement of the finger tab 210 of each circuit board 200 allows that board to push against the board holder plate 300 so that if the heat stake tabs 210 are slightly misaligned relative the tab holes 330, this can be corrected. Alternatively, or in addition thereto, slight displacement of the finger tab 210 allows a possible misalignment between an edge of the circuit board 200 and either the reflector's first guide rib 115 or the board holder plate's second guide rib 315 during placement of parts, but before heat staking, to be corrected. These protruding finger tabs 210 further define regions where electrical connectors can be located on the circuit boards 200.

FIG. 10 shows the lamp reflector assembly 10 from a rear view with the reflector rear surface 110 surrounded by three circuit boards 200 (one of which carries LEDs), each arranged generally along the principal major side of the reflector 100.

Advantageously, either one or both of the first and second guide ribs 115, 315 have a shape that forces the mounted circuit board toward the rear face 110 of the reflector 100. The shape may include an inclined surface 415 that will bear on a rear face of the mounted circuit board 200, thereby forcing the mounted circuit board 200 towards the rear face 110 of the reflector 100. Alternatively, the guide ribs 115, 315 themselves may by inclined 420, extending at an angle relative to a mounting surface of the reflector 100 or holder plate 300 to thereby force the mounted circuit board 200 towards the rear face 110 of the reflector 100. In one embodiment, the first guide ribs 115 may be inclined three (3) degrees away from the reflector part's die pull direction in the case of an injection molded reflector 100, typically molded from a heat-resistant thermoset plastic compound.

The first guide ribs 115 alone may have the shape that forces the mounted circuit board 200 toward the rear face 110 of the reflector 100. The second guide ribs 315 alone may have the shape that forces the mounted circuit board 200 toward the rear face 110 of the reflector 100.

Advantageously, either one or both of the first and second guide ribs 115, 315 comprises a locator rib 425. The locator rib 425 engages the mounted circuit board 200 to thereby locate a position of the circuit board 200 laterally with respect to the rear face 110 of the reflector 100. The first guide ribs 115 alone may comprise the locator rib 425. The second guide ribs 315 alone may comprise the locator rib 425.

Advantageously, the lamp circuit board 200 includes a notch 215 extending into a perimeter edge of the lamp circuit board 200. The notch 215 engages with the locator rib 425 to locate the position of the circuit board 200 laterally with respect to the rear face 110 of the reflector 100.

Embodiments include plural lamp circuit boards 200 located by each circuit board holder plates 300, each board holder plate fixedly corresponding lamp circuit boards 200 in a corresponding predetermined X, Y, Z position 20 with respect to the rear face of the reflector 100, with each light element 205 of each lamp circuit board 200 positioned adjacent to a corresponding one of the slotted holes 125 so that light emitted from the each light element 205 passes through the corresponding slotted hole 125 to thereby illuminate the reflective front surface 105 of the reflector 100.

Advantageously, the rear face 110 of the circuit board holder plate 300 further comprises a driver board surface area 435 for attaching a driver board to the rear face of circuit board holder plate 300 at the driver board surface area 435. Electrical connections may extend between the driver board and each lamp circuit board(s) 200.

As shown in FIGS. 6-7, the circuit board first guide ribs 115 are positioned on a portion of rear face 110 of reflector 100 to hold circuit board holder plate 300 approximately orthogonally to an adjacent portion of rear face 110 of the reflector 100. However, circuit board first guide ribs 115 may be positioned to hold the circuit board holder plate 300 non-orthogonally to the portion of rear face 110 of the reflector 100.

The first guide ribs 115 of the reflector 100 are of any form suitable for receiving the lamp circuit and, in conjunction with the second guide ribs 315 of the circuit board holder plate 300, fixedly mounting the lamp circuit board 200 in the design predetermined X, Y, Z position 20 with respect to the rear face 110 of the reflector 100.

As shown in FIG. 8, each of the first and second guide ribs 115, 315 may, e.g., comprise at least one projecting first rib element located adjacently another guide element (e.g. a projecting second rib element) such that a lamp circuit board receiving space 430 is defined therebetween. For the first guide ribs 115, the another guide element 120 may a continuous part of the reflector extending between plural first rib elements and spaced apart therefrom (FIG. 7). The first and second rib elements 115, 315 may project from a local surface orthogonally or non-orthogonally.

While several embodiments of the present disclosure are described and illustrated herein, those of ordinary skill in the art will readily envision other means and/or structures for performing the functions and/or obtaining the results and/or one or more of the advantages described herein, and each such variation and/or modification is deemed within the scope of the present disclosure. All parameters, materials, and configurations described herein are exemplary and the actual parameters, materials, and/or configurations will depend upon the specific application for which the teachings of the present disclosure are used. Those skilled in the art will recognize, or be able to ascertain using no more than routine experimentation, many equivalents to the specific embodiments described herein. It is therefore understood that the foregoing embodiments are presented by way of example and that, within the scope of the appended claims and equivalents thereto, the disclosure may be practiced otherwise than as specifically described and claimed. The present disclosure is directed to each individual feature, system, kit, and/or method described herein. In addition, any combination of two or more such features, systems, kits, and/or methods, if such are not mutually inconsistent, is within the scope of the present disclosure.

All definitions, as defined and used herein, should be understood to control over dictionary definitions, definitions in documents incorporated by reference, and/or ordinary meanings of the defined terms.

The indefinite articles "a" and "an" as used herein in the specification and in the claims, unless clearly indicated to the contrary, are understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

The following lists reference numeral used herein:

10 lamp reflector assembly
20 design X, Y, Z position
100 lamp reflector
105 front face defining a reflective front surface
110 rear face defining a rear surface
115 first guide rib
120 another guide element
125 slotted holes
130 heat stake tab
200 lamp circuit board
205 solid-state light element
210 finger tab
215 notch
300 circuit board holder plate
315 second guide rib
320 finger slot
325 screw hole
330 tab holes
400 securing element
405 screw
410 weld
415 inclined surface
420 inclined rib
425 locator rib
430 lamp circuit board receiving space
435 driver board surface area This invention, including all embodiments shown and described herein, could be used alone or together and/or in combination with one or more of the features covered by one or more of the claims set forth herein, including but not limited to one or more of the features or steps mentioned in the bullet list in the Summary of the Invention and the claims.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A lamp reflector assembly, comprising:

a lamp circuit board, said lamp circuit board having one or more solid-state light elements positioned on a first side of said lamp circuit board;

a lamp reflector; and a circuit board holder plate adapted to be mounted to said lamp reflector, wherein said lamp reflector includes a surface and a first guide on said surface for receiving a first perimeter edge of said lamp circuit board, said circuit board holder plate includes a second guide for receiving a second perimeter edge of said lamp circuit board opposing said first perimeter edge of said lamp circuit board, said first guide includes a first guide rib having a first inclined surface that abuts a second side of said lamp circuit board and said first perimeter edge of said lamp circuit board abuts said circuit board holder plate when said circuit board holder plate is secured to said lamp reflector, said second guide includes a second guide rib provided on a first surface of said circuit board holder plate, said second guide rib having a second inclined surface that abuts said second side of said lamp circuit board and said second perimeter edge of said lamp circuit board abuts said lamp reflector when said circuit board holder plate is secured to said lamp reflector, said circuit board holder plate further comprises a finger slot, said lamp circuit board includes a finger tab extending from said second perimeter edge of said lamp circuit board, and when said circuit board holder plate is secured to said lamp reflector, the finger tab of said lamp circuit board extends through said finger slot of said circuit board holder plate so as to extend beyond a second surface of said circuit board holder plate.

2. The lamp reflector assembly of claim 1, wherein said at least one first guide comprises a locator rib, said locator rib engaging a notch of said lamp circuit board to position said lamp circuit board.

3. The lamp reflector assembly of claim 2, wherein said notch of said lamp circuit board extends into said first perimeter edge of said lamp circuit board.

4. The lamp reflector assembly of claim 1, wherein said lamp reflector further comprises a heat stake tab extending from said surface of said lamp reflector, said circuit board holder plate further comprises a tab hole positioned to receive said heat stake tab therethrough when said circuit board holder plate is positioned to hold said lamp circuit board to said lamp reflector, and with said circuit board holder plate holding said lamp circuit board to said lamp reflector, said heat stake tab is configured to provide a weld for securing said circuit board holder plate to said lamp reflector together.

5. The lamp reflector assembly of claim 1, wherein said circuit board holder plate is transparent, thereby facilitating visual inspection of whether said first guide and said second guide hold said lamp circuit board at the predetermined position.

6. The lamp reflector assembly of claim 1, wherein said circuit board holder plate is generally flat.

7. The lamp reflector assembly of claim 1, further comprising one or more other lamp circuit boards, said circuit board holder plate and said lamp reflector holding said one or more other lamp circuit boards when said circuit board holder plate is secured to said lamp reflector.

8. The lamp reflector assembly of claim 1, further comprising a screw configured to secure said circuit board holder plate to said lamp reflector.

9. A lamp reflector assembly, comprising:

a plurality of lamp circuit boards, each of said plurality of lamp circuit boards having one or more solid-state light elements positioned on a first side of said lamp circuit board;

a lamp reflector having a plurality of wall surfaces, a front face defining a reflective front surface, and a rear face defining a rear surface, said lamp reflector including a plurality of first guide ribs located on said rear face, and said plurality of wall surfaces having one or more apertures through which light rays pass; and a circuit board holder plate having a plurality of second guide ribs, said circuit board holder plate being secured to said lamp reflector, wherein said plurality of first guide ribs of said lamp reflector and said plurality of second guide ribs of said circuit board holder plate are adapted to engage said plurality of lamp circuit boards in a generally perpendicular position between said lamp reflector and said circuit board holder plate, said plurality of lamp circuit boards being captured between said plurality of first guide ribs and said plurality of second guide ribs in order to hold said plurality of lamp circuit boards between said circuit board holder plate and said rear surface of said lamp reflector and to secure said plurality of lamp circuit boards in said predetermined positions when said circuit board holder plate is secured to said lamp reflector, said plurality of second guide ribs cooperate to define a receiving section for receiving said plurality of lamp circuit boards, said plurality of lamp circuit boards are generally planar and each comprises a longitudinal surface for supporting said one or more solid-state light elements, said longitudinal surfaces of said plurality of lamp circuit boards being positioned in different planes with respect to said lamp reflector, said plurality of first guide ribs including a first guide rib having a first inclined surface that abuts a second side of one of said plurality of lamp circuit boards and a first perimeter edge of said one of said plurality of lamp circuit boards abuts said circuit board holder plate when said circuit board holder plate is secured to said lamp reflector, said plurality of second guide ribs including a second guide rib provided on a first surface of said circuit board holder plate, said second guide rib having a second inclined surface abuts said second side of said one of said plurality of lamp circuit boards and a second perimeter edge of the one of said plurality of lamp circuit boards abuts said lamp reflector when said circuit board holder plate is secured to said lamp reflector, said circuit board holder plate further comprises a finger slot, said one of said plurality of lamp circuit boards includes a finger tab extending from said second perimeter edge of said one of said plurality of lamp circuit boards, and when said circuit board holder plate is secured to said lamp reflector, the finger tab of said one of said plurality of lamp circuit boards extends through said finger slot of said circuit board holder plate so as to extend beyond a second surface of said circuit board holder plate.

10. The lamp reflector assembly of claim 9, wherein at least one of said plurality of first guide ribs comprises a locator rib, said locator rib engaging the one of said plurality of lamp circuit boards to thereby locate a position of the one of said plurality of lamp circuit boards laterally with respect to said rear face of said reflector.

11. The lamp reflector assembly of claim 10, wherein the one of said plurality of lamp circuit boards comprises a notch extending into said first perimeter edge of the one of said plurality of lamp circuit boards, said notch positioned to engage with said locator rib to locate the position of the one of said plurality of lamp circuit boards laterally with respect to said rear face of said reflector.

12. The lamp reflector assembly of claim 9, wherein said lamp reflector further comprises heat stake tabs extending from said rear face, said circuit board holder plate further comprises tab holes positioned to receive said heat stake tabs therethrough when said circuit board holder plate mounts said plurality of lamp circuit boards to said lamp reflector, and with said circuit board holder plate mounting said plurality of lamp circuit boards to said lamp reflector, said heat stake tabs are configured to provide a weld that secures said circuit board holder plate and said lamp reflector together.

13. The lamp reflector assembly of claim 9, wherein said circuit board holder plate is transparent, thereby facilitating visual inspection of said plurality of first guide ribs and said plurality of second guide ribs mounting said plurality of lamp circuit boards in the predetermined position with respect to said rear face of said reflector.

14. The lamp reflector assembly of claim 9, wherein said circuit board holder plate is generally flat.

* * * * *